US006142235A

United States Patent [19]

Monjure et al.

[11] Patent Number: 6,142,235

[45] **Date of Patent: *Nov. 7, 2000**

[54] BOTTOM-SUPPORTED GUIDANCE DEVICE FOR ALIGNMENT OF MULTIPLE WELLBORES IN A SINGLE CONDUCTOR

[75] Inventors: Noel A. Monjure, Houston; Charles D. Bridges, Cypress, both of Tex.

[73] Assignee: ABB Vetco Gray Inc., Houston, Tex.

[ * ] Notice: This patent is subject to a terminal disclaimer.

[21] Appl. No.: 09/132,979

[22] Filed: Aug. 12, 1998

Related U.S. Application Data

[63] Continuation-in-part of application No. 08/759,542, Dec. 5, 1996, Pat. No. 5,810,086.

[51] Int. Cl.[7] ..... E21B 43/01

[52] U.S. Cl. ..... 166/349; 166/313; 166/366; 175/5

[58] Field of Search ..... 166/349, 358, 166/366, 313, 242.3; 175/5

[56] References Cited

U.S. PATENT DOCUMENTS

| | | | |
|---|---|---|---|
| 1,900,163 | 3/1933 | Dana et al. . | |
| 3,330,349 | 7/1967 | Owsley et al. | 166/242.3 |
| 4,396,075 | 8/1983 | Wood et al. . | |
| 5,330,007 | 7/1994 | Collins et al. . | |
| 5,458,199 | 10/1995 | Collins et al. . | |
| 5,560,435 | 10/1996 | Sharp . | |
| 5,810,086 | 9/1998 | Bridges . | |

FOREIGN PATENT DOCUMENTS

| | | |
|---|---|---|
| WO97/09508 | 3/1997 | WIPO . |

*Primary Examiner*—William Neuder
*Attorney, Agent, or Firm*—Felsman, Bradley, Vaden, Gunter & Dillon, L.L.P.; James E. Bradley

[57] ABSTRACT

Two or more opposing and outward facing profiles are fabricated and joined to each other along their outer edges, forming a section of a guide string. The sections of the guide string are secured together in an assembly and lowered into a single conductor. The assembly lands on the bottom of the well and may support its own weight. The guide string defines two separate longitudinal cavities or sections of the well. Each separate cavity allows drilling and installation of casing in the conductor.

20 Claims, 1 Drawing Sheet

BOTTOM-SUPPORTED GUIDANCE DEVICE FOR ALIGNMENT OF MULTIPLE WELLBORES IN A SINGLE CONDUCTOR

This application is a continuation-in-part of application Ser. No. 08/759,542, filed Dec. 5, 1996, now U.S. Pat. No. 5,810,086 entitled "Single Riser With Two Wellheads," and is hereinafter incorporated by reference.

TECHNICAL FIELD

This invention relates generally to drilling wells, and more particularly to an apparatus for drilling two wells in a single conductor.

BACKGROUND ART

A typical offshore well installation comprises a single conductor in a single well. If necessary, several wells may be located side by side in a template. Multiple wells may also be drilled within a single conductor pipe. One example of such an installation utilized a conductor with a diameter the size of a leg of a drilling platform and contained up to 12 wells. That installation utilized a guide member lowered on a riser into the conductor. The guide member had slots for each well along its periphery. U.S. Pat. No. 5,458,199 shows two wells in a conductor with a guide member at the lower end of the conductor, but an improved guide means is desirable.

SUMMARY OF THE INVENTION

Two or more opposing and outward facing profiles are fabricated and joined to each other along their outer edges, forming a section of a guide string. The sections of the guide string are secured together in an assembly and lowered into a single conductor. The assembly lands on the bottom of the well and may support its own weight. The guide string defines two separate longitudinal cavities or sections of the well. Each separate cavity allows drilling and installation of casing in the conductor.

DETAILED DESCRIPTION OF THE INVENTION

Figure 2:
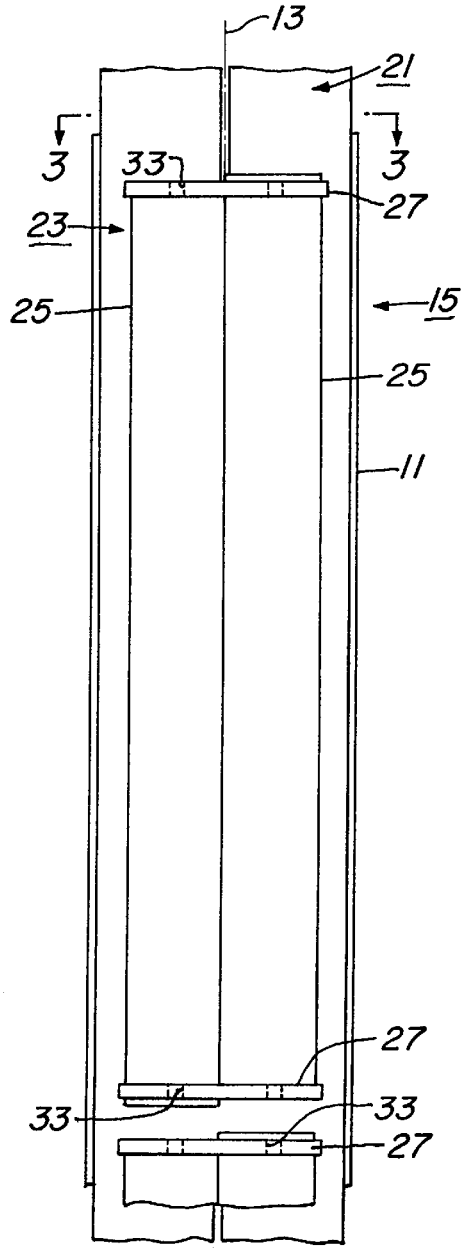
FIG. 2 is a fragmented, partially exploded side view of the segment and guidance system of FIG. 1 shown installed in a conductor pipe with two strings of casing.

Referring to FIG. 2, a large diameter string of conductor 11 with a longitudinal axis 13 is installed in a well 15 to a first depth. Conductor 11 is a steel pipe, typically 36 inches in diameter. Conductor 11 normally extends from a drilling platform at sea level downward to the sea floor and may extend several hundred feet into the earth.

Figure 1:
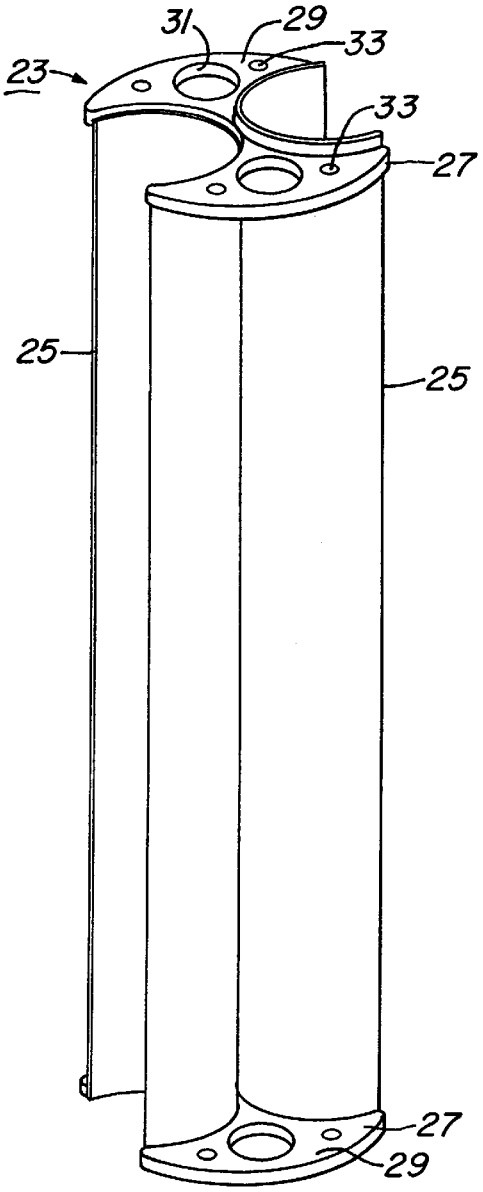
FIG. 1 is an isometric view of a single segment of a guidance system constructed in accordance with the invention.
Figure 3:
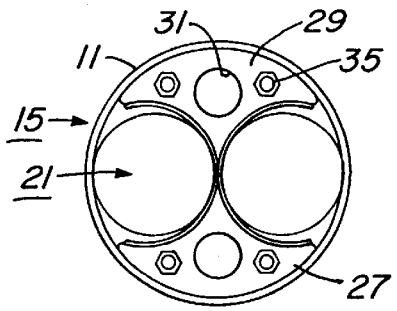
FIG. 3 is sectional top view of the segment and guidance system of FIG. 1 taken along the line 3—3 in FIG. 2.

A guidance system 21 comprising a plurality of segments 23 (FIG. 1) is lowered into conductor 11. Each segment 23 comprises two symmetrically formed, semi-cylindrical sections 25 which face in opposite directions. The sections 25 of each segment 23 abut one another tangentially along their outer surfaces. In the preferred embodiment, each section 25 is formed from 30-foot long pipe joint halves which were cut longitudinally, then welded to each other back-to-back. The ends of sections 25 are connected together by partitions 27 (FIG. 2) which are preferably welded to sections 25. Partitions 27 are parallel to one another and spaced apart by the length of sections 25 (FIGS. 1 and 2). As shown in FIG. 3, partitions 27 have outer edges or webs 29 that extend out to the inner diameter of conductor 11, thereby dividing conductor 11 into two halves. Webs 29 have an outer dimension that is transverse to longitudinal axis 13 and approximately equal to the inner diameter of conductor 11.

Each web 29 has at least one separate bore 31 for temporary or permanent installation of a circulating or cementing string. In the embodiment shown (FIG. 3), the axes of bores 31 and sections 25 are located 90 degrees apart from each other relative to longitudinal axis 13 of conductor 11. Webs 29 also have a plurality of smaller holes 33 which are used in conjunction with fasteners 35 (FIG. 3) to connect segments 23 to one another.

Referring to FIG. 2, segments 23 have a universal indexing end connection and are designed to be stacked end to end. To accomplish this, one of sections 25 is vertically elevated above the other section 25 as each segment 23 is assembled. In the embodiment shown, the sections 25 on each segment 23 are vertically staggered approximately one inch above and below a partition 27, respectively, so that the ends of sections 25 on a segment 23 will insert into web 29 of an adjacent segment 23. As shown in FIG. 2, the segments 23 are stacked so that the elevated section 25 is always on the right and the lower section 25 is always on left. Referring to the lower end of FIG. 2, when a segment 23 is lowered on top of a landed segment 23, the section 25 on the lower right side will extend up into the recess within web 29 below the upper right section 25, and the section 25 on the upper left will extend down into the recess in web 29 above the lower left section 25. Staggering the sections 25 facilitates alignment between the segments 23 when they are stacked on top of one another during construction of guidance system 21.

In operation, individual segments 23 are fabricated ahead of time and set aside for installation. The first segment 23 which is to be landed at the bottom of well 15 is secured to a conventional drilling rig elevator and lowered into conductor 11. A mechanism such as a slips (not shown), is used to grip and hold the upper end of segment 23 in a conventional manner. The next segment 23 is then lowered and landed on top of the first segment 23 in the same manner so that each of their sections 25, bores 31 and holes 33 align. Fasteners 35 (FIG. 3) are then installed to rigidly secure the two segments 23 to each other. Subsequent segments 23 are likewise installed and the elevator continues to lower the guidance system 21 into conductor 11. This sequence is repeated until the first segment 23 reaches and lands on the bottom of well 15. The upper end of guidance system 21 will be landed in or located close to a plate (not shown) which is mounted to the upper end of conductor 11 and the elevator is removed. Guidance system 21 will preferably support its own weight.

A conventional drilling diverter (not shown) is installed on the plate and a string of drill pipe is run through the diverter and one set of sections 25. The drill pipe is used to drill a first smaller diameter well from the lower end of conductor 11 to a desired depth. Circulation will be up conductor 11 and the diverter. Referring to FIG. 2, a first string of casing 41 is run through the first large opening and set of sections 25, down conductor 11, and through the new well bore before it is cemented in place.

Repeating the sequence, the drill pipe is then lowered through the diverter and down the other side of guidance system 21 and partitions 27 to drill a second well bore. The drill pipe is removed and a second string of casing 43 is cemented in its place. After both strings of casing 41, 43 are in place, the interior of the lower end of conductor 11 is plugged off by pumping cement from a pump down one of the bores 31. When the wells are complete, casing strings 41, 43 extend upward to the surface and wellhead housings are mounted to them. A cement plug will be located at the bottom of conductor 11. The guidance system 21 comprising the plurality of segments 23 remains in conductor 11.

The invention has several advantages. The invention provides a guidance system for sequentially guiding a drill string to drill two wells in a single conductor bore. The invention also provides means for separating the casings for the two wells during completion of the wells.

While the invention has been shown in only one of its forms, it should be apparent to those skilled in the art that it is not so limited, but is susceptible to various changes without departing from the scope of the invention. For example, more than two sections may be used in each of the segments to drill an even larger number of wells through a single conductor.

What is claimed is:

1. An apparatus, comprising:

a string for extending from a surface level into a well, the string having at least two elongated members extending substantially the length of the string, each of the elongated members having a concave face facing away from each other radially outward relative to a longitudinal axis of the string, the concave faces extending substantially the length of the string, the elongated members being secured to each other and adapted to be positioned within a wellbore to divide the wellbore into at least two portions, such that a drill string and casing may be run sequentially down each portion of the wellbore, for drilling and casing separate wells below the wellbore.

2. The apparatus of claim 1 wherein the string is adapted to land on a bottom of the well and support its own weight.

3. The apparatus of claim 1 wherein each elongated member is made up of a plurality of segments having ends which are secured together.

4. The apparatus of claim 1 wherein the elongated members have convex backs which abut each other.

5. An apparatus, comprising:

a string for extending into a well, the string having at least two elongated members extending substantially the length of the string, each of the elongated members having a concave face facing away from each other radially outward relative to a longitudinal axis of the string, the elongated members being secured to each other and adapted to be positioned within a wellbore to divide the wellbore into at least two portions, such that a drill string and casing may be run sequentially down each portion of the wellbore, for drilling and casing separate wells below the wellbore; and a partition mounted between ends of the segments to secure the segments together.

6. The apparatus of claim 5 wherein each of the partitions comprises a flat plate.

7. The apparatus of claim 5 wherein each of the partitions has at least two outer edges which are adapted to contact the bore of the conductor.

8. An apparatus for creating two wells in a single bore, the apparatus comprising in combination:

a plurality of segments, each comprising a pair of semi-tubular sections, each of the sections having an opening along its length and being parallel to one another with the openings facing away from each other and away from a longitudinal axis of the segments;

a partition secured to opposite ends of each of the segments; and wherein the segments are adapted to be stacked on top of one another and secured to each other by the partitions from a bottom of the bore to a top of the bore to divide the bore into portions so that a drill string and casing may be run sequentially down each portion of the bore, for drilling and casing separate wells below the bore.

9. The apparatus of claim 8 wherein the partitions abut and are fastened with fasteners to one another when the segments are stacked in the bore.

10. The apparatus of claim 8 wherein each of the partitions comprises a flat plate.

11. The apparatus of claim 8 wherein each of the partitions has at least two outer edges which are adapted to contact a sidewall of the bore.

12. The apparatus of claim 8 wherein each of the semi-tubular sections is semi-cylindrical.

13. The apparatus of claim 8 wherein each of the sections in each of the segments is vertically staggered relative to the other section in the segment to facilitate stacking of the segments in the bore.

14. A well, comprising:

a tubular conductor which extends to a first depth;

a plurality of segments, each comprising a pair of semi-tubular sections, each of the sections having an opening along its length and being parallel to one another with the openings facing in opposite directions relative to a longitudinal axis of the segments;

a partition secured to opposite ends of each of each of the segments, each partition having at least two outer edges which contact the bore of the conductor; and wherein the segments are adapted to be stacked on top of one another and secured to each other by the partitions from a bottom of the conductor to a top of the conductor to divide the conductor into portions so that a drill string and casing may be run sequentially down each portion of the conductor, for drilling and casing separate wells below the conductor; and wherein the partitions abut and are fastened with fasteners to one another when the segments are stacked in the conductor.

15. The apparatus of claim 14 wherein each of the partitions comprises a flat plate.

16. The apparatus of claim 14 wherein each of the semi-tubular sections is semi-cylindrical.

17. The apparatus of claim 14 wherein each of the sections in each of the segments is vertically staggered relative to the other section in the segment to facilitate stacking of the segments in the conductor.

18. A method for creating two wells in a single wellbore having a longitudinal axis, comprising:

a) extending at least two elongated members into the wellbore, each of the elongated members having a concave face extending substantially the length of the wellbore, the faces facing away from each other radially outward relative to the axis, and the elongated members being secured to each other;

b) positioning the elongated members within the wellbore to divide the wellbore into at least two portions; and c) running a drill string and a casing sequentially down each portion of the wellbore for drilling and casing separate wells below the wellbore.

19. The method of claim 18 wherein step (a) comprises landing the elongated members at a bottom of the wellbore such that they support their own weight.

20. A method for creating two wells in a single wellbore having a longitudinal axis, comprising:

a) extending at least two elongated members into the wellbore, each of the elongated members having a concave face, the faces facing away from each other radially outward relative to the axis, and the elongated members being secured to each other;

b) positioning the elongated members within the wellbore to divide the wellbore into at least two portions; and c) running a drill string and a casing sequentially down each portion of the wellbore for drilling and casing separate wells below the wellbore; and mounting a plurality of partitions between the elongated members to secure them together.

* * * * *